United States Patent [19]

Spanski et al.

[11] 3,995,831

[45] Dec. 7, 1976

[54] FORCE FEEDBACK CONTROLLED WINCH

[75] Inventors: Paul L. Spanski, Bloomfield Hills; Ronald R. Beck, St. Clair Shores, both of Mich.

[73] Assignee: The United States of America as represented by the Secretary of the Army, Washington, D.C.

[22] Filed: Dec. 17, 1974

[21] Appl. No.: 533,567

[52] U.S. Cl. ..... 254/173 R; 60/391; 60/445; 214/1 CM

[51] Int. Cl.[2] ..... B66D 1/48

[58] Field of Search ..... 254/173 R; 214/147, 214/141, 138 R, 762, 130 R, 1 CM; 60/391, 388, 445, 465; 91/505, 506

[56] References Cited

UNITED STATES PATENTS

| | | | |
|---|---|---|---|
| 3,333,716 | 8/1967 | Ziegler | 214/130 R |
| 3,487,958 | 1/1970 | Shook et al. | 214/138 R |
| 3,618,786 | 11/1971 | Fick | 214/141 |
| 3,633,464 | 1/1972 | Aoyama et al. | 60/445 |
| 3,754,400 | 8/1973 | Parquet | 60/445 |
| 3,817,033 | 6/1974 | Appel et al. | 60/445 |
| 3,864,912 | 2/1975 | Othen et al. | 60/445 |
| 3,878,679 | 4/1975 | Stevenpiper | 60/445 |

*Primary Examiner*—Robert J. Spar
*Assistant Examiner*—Kenneth Noland
*Attorney, Agent, or Firm*—Peter A. Taucher; John E. McRae; Nathan Edelberg

[57] ABSTRACT

A cable winch control having means for sensing the magnitude of the load in relation to the torque being delivered by the power means to the winding drum. The sensed signal is fed back to a manual controller for the drum winding means, to alert the operator to dangerous load situations that could damage the equipment or break the cable. The feedback signal exerts a restraining force on the controller opposing movement thereof, from a neutral "low-load" position to either the "wind-in" or "wind-out" condition. Therefore, the feedback signal has a fail-safe characteristic that prevents runaway movement of the controller in either direction.

4 Claims, 1 Drawing Figure

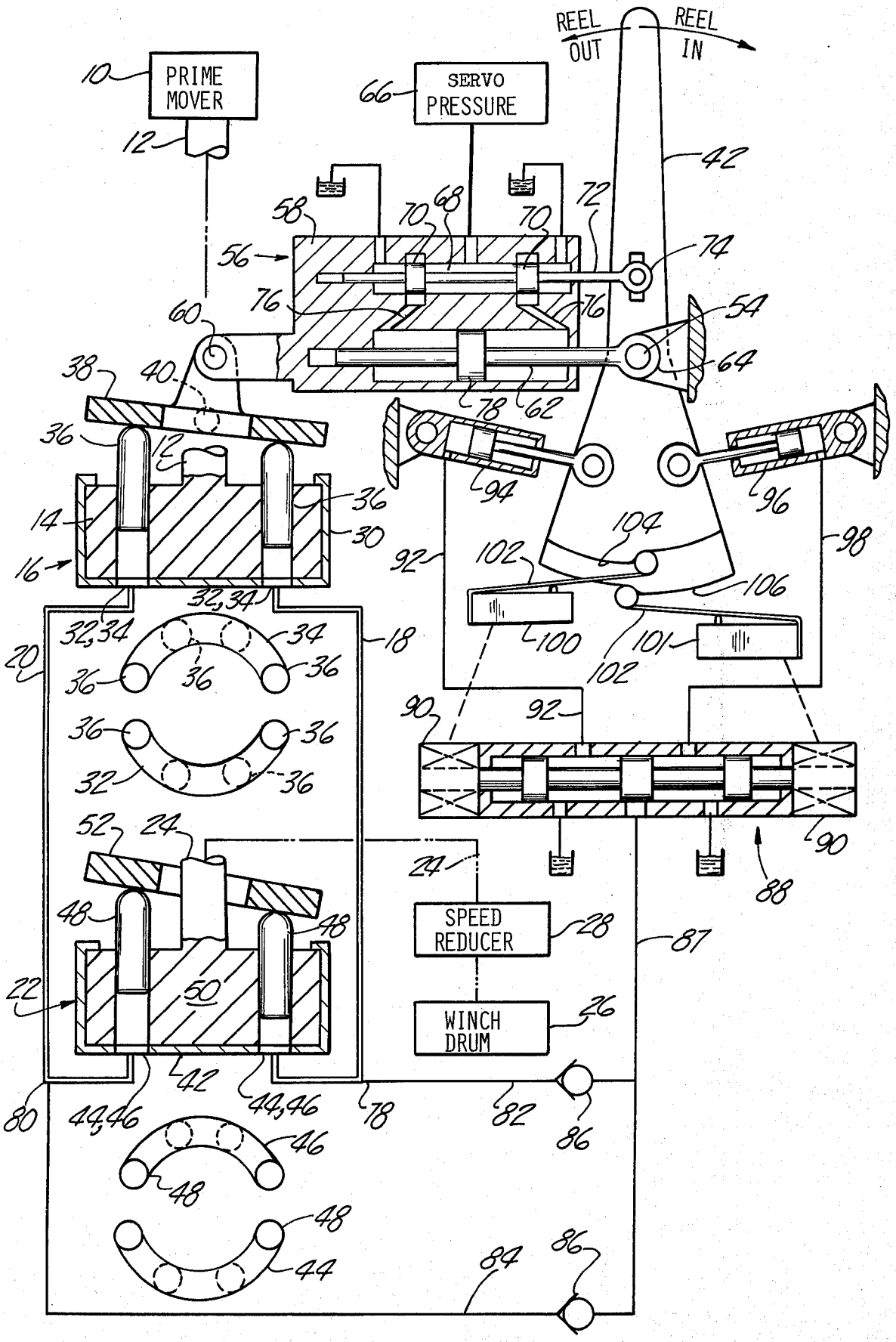
PRIME MOVER
SERVO PRESSURE
REEL OUT
REEL IN
SPEED REDUCER
WINCH DRUM

FORCE FEEDBACK CONTROLLED WINCH

The invention described herein may be manufactured, used, and licensed by or for the Government for governmental purposes without payment to us of any royalty thereon.

BACKGROUND AND SUMMARY OF THE INVENTION

Traditionally winches of all types have employed open loop control systems. The operator initiates a signal and the winch responds. Generally this signal controls the speed of the winch and the direction of rotation of the drum (reel in or reel out). The operator does not have positive knowledge of the forces generated by the winch. Indirect cues are available such as the sounds the winch machinery makes as it is loaded, but it takes a highly trained operator to relate these to loads in the winch cable. A natural feel for the force exerted by a winch is very desirable when winching relatively delicate equipment, such as the recovery of light vehicles or pulling a coaxial cable through a conduit. An unexpected obstruction could result in damage to the equipment being winched or a parted cable.

This invention was conceived to overcome this problem by providing the operator with a force feedback signal proportional to the force the winch exerts on the load. This type of control is termed bilateral, that is, force information signals are reflected in either direction of the control system, i.e. reel-in or reel-out.

THE DRAWINGS

The single FIGURE illustrates the principal features of a winch control system embodying the invention. The system comprises three principal mechanisms, namely the winch power means, the manual controller for the power means, and the load feedback signal means which exerts a restraining force on the controller proportional to the magnitude of the load.

WINCH POWER MEANS

A gasoline engine or other prime mover 10 has a output shaft 12 that imparts rotary motion to the barrel portion 14 of a conventional hydraulic pump 16. Hydraulic output from pump 16 is delivered through line 18 or 20 to a conventional hydraulic motor 22, whose output shaft 24 is connected to the winch drum 26 via speed reducer gearing 28. Pump 16 and motor 22 constitute a hydrostatic transmission available from a commercial source such as Vickers Co. The pump and motor are arranged as a closed loop hydraulic system.

Conventional pump 16 comprises a stationary casing 30 having semi-circular ports 32 and 34 for controlling hydraulic flow to or from pistons 36 that are slidably disposed within rotary barrel 14. The drawing shows two pistons, but in practice eight or more such pistons are used. The outer ends of the pistons engage an annular reaction surface formed on adjustable thrust plate 38. Tranverse shaft means mounts the plate for adjustable movement around the transverse axis 40 in response to manual movement of a controller 42 (shown at the right of the FIG.).

Thrust plate 38 has three ranges of movement, namely a neutral "no flow" position (at right angles to the pistons), various "forward flow" positions (tilted clockwise from the no flow position), and various "reverse flow" positions (tilted counterclockwise from the no-flow position). The thrust plate is shown slightly tilted from the neutral position in a clockwise direction.

When the thrust plate is adjusted clockwise from the neutral position line 18 constitutes the high pressure pump output. When the thrust plate is adjusted counterclockwise from the neutral position, line 20 constitutes the high pressure pump output. In each case the "other" line constitutes a pump supply line at essentially drain pressure.

Conventional hydraulic motor 22 comprises a stationary casing 42 having semi-circular ports 44 and 46 for controlling hydraulic flow to or from pistons 48 slidably disposed within rotary barrel 50. The ends of the pistons engage an annular reaction surface on stationary thrust plate 52. Motor 22 is a constant displacement device arranged to delivery power to shaft 24 in accordance with the hydraulic pressures developed by pump 16.

When the pump thrust plate 38 is adjusted so that line 18 delivers high pressure fluid to motor 22 the motor output shaft 24 is caused to rotate in one direction (e.g. the cable reel-in direction). When the pump thrust plate 38 is adjusted so that line 20 delivers high pressure fluid to motor 22 output shaft 24 is caused to rotate in the opposite direction (e.g. the cable reel-out direction). When the pump thrust plate 38 is adjusted to its neutral no-flow position the motor output shaft 24 is held motionless in a semi-locked condition; the hydraulic pressures below pistons 48 are equalized so that motor 22 acts as a brake opposing any load that may exist at the winding drum (the equipment being hoisted by the cable). If the load is sufficiently great it can produce reverse motion of shaft 24; the motor then acts as a pump to relieve the stress.

During use of the winch the load interacts with the power means (10, 16, 22) to determine the high side pressure (line 18 or 20). The load is transmitted through motor 22 to the hydraulic fluid in the high side of the system (line 18 or 20). The high side pressure is thus a function of pump displacement (adjusted position of thrust plate 38) and the load on the winch drum. With a given pump displacement any increase in the load will cause an increase in the high side pressure (pump output). The present invention provides a pressure sensing mechanism responsive to such pressure increases, i.e. a sensing mechanism for generating a signal proportional to the tension imposed on the cable by interaction of the load and the power means; the signal is translated into a force restraining the manual controller from such inadvertant movement as would overstress the winch system. The general aim is to give the operator a feel for excessive loads before such loads can damage the equipment.

MANUAL CONTROLLER

Manual controller 42 is shown as a manual lever fulcrummed at 54 and connected to thrust plate 38 by means of a hydraulic linkage 56. The linkage serves merely to transmit motion from lever 42 to thrust plate 38. The linkage is constructed as a "hydraulic" device for power-assist reasons, i.e. a relatively small manual pressure on lever 42 products a relatively great actuating force on thrust plate 38. In some instances a mechanical link could be substituted for the hydraulic linkage.

The illustrated hydraulic linkage comprises a housing 58 pivotally connected to thrust plate 38 at 60, and a piston rod 62 pivotally connected to the lever by means of an eye element 64 (surrounding pivot pin 54). Hydraulic pressure from source 66 is applied to central space 68 between two valve spools 70 carried by a rod 72; that rod has a pin-slot connection 74 with manual lever 42. Each spool 70 controls flow through a separate passage 76 leading to one side of the actuator piston 78 carried by rod 62.

Assuming manual lever 42 is moved from the illustrated neutral postion in the clockwise direction (reel-in direction) rod 72 will be drawn to the right, thereby, causing the rightmost valve 70 to admit servo fluid to the right side of piston 78; the leftmost valve 70 will expose the space to the left of piston 78 to the drain. Pressurization of the space to the right of piston 78 will cause housing 58 to shift to the right (relative to the piston), thereby moving thrust plate 38 in a clockwsie direction around pivot axis 40. Such movement of housing 58 will "reset" spools 70 to their illustrated positions, thus terminating the movement of housing 58. The housing will remain "centered" relative to piston 78 and spools 70 until the next manual force input to lever 42. The servo control action takes place whether lever 42 is being moved clockwise (reel-in operation) or counterclockwise (reel-out operation). In either case the hydraulic linkage transmits a magnified actuating force from manual controller 42 to thrust plate 38.

LOAD FEEDBACK SIGNAL MEANS

The load feedback signal means broadly encompasses three separate cooperating mechanisms, as follows:

1. means at 78, 80 for sensing the high side pressure in line 18 or 20,
2. hydraulic expansible chamber type actuator means 94, 96 for applying the sensed pressure as a restraining force on manual controller 42, and
3. valve means 88 for controlling flow to the actuator means so that the restraining force is applied in the proper direction during both the reel-in and reel-out operations.

Pressures are sensed at taps 78 and 80 in respective ones of lines 18 and 20. Sensor lines 82 and 84, each containing a check valve 86, lead through line 87 to a conventional directional valve 88 equipped with actuating solenoids 90. Assuming the right solenoid 90 is energized to pull the spool valve elements to the right, then pressurized fluid from energizer line 87 is directed through branch line 92 to hydraulic cylinder or similar expansible chamber 94; the other hydraulic cylinder 96 is drained through branch line 98 and the spool valve. When the left solenoid 90 is energized pressurized fluid from energizer line 87 is directed through branch line 98 to cylinder 96; cylinder 94 is drained through line 92 and the spool valve. Valve 88 can be a conventional four way solenoid valve or two separate solenoid valves.

Solenoids 90 are conveniently programmed by means of snap action switches 100 and 101 having roller arms 102 engaged with cam surfaces 104 and 106 on lever 42. When lever 42 is moved clockwise from the neutral position cam 106 trips switch 101 to effect energization of the right solenoid 90, thereby causing pressurized fluid from line 87 to be admitted to cylinder 94; cylinder 94 thereby imposes a restraining force against continued clockwise movement of lever 42. When lever 42 is moved counterclockwise from the neutral position cam 104 trips switch 100 to effect energization of the left solenoid 90, thereby causing pressurized fluid from line 87 to be admitted to cylinder 96; cylinder 95 thereby imposes a restraining force against continued counterclockwise movement of lever 42.

NATURE OF THE RESTRAINING FORCE

The restraining force imposed on lever 42 by the hydraulic expansible chamber type actuator (94 or 96) is proportional to the high side pressure in the main hydraulic system (line 18 or 20). Check valves 86 insure that line 87 will receive and convey this high side pressure to the "selected" actuator (94 or 96) whether the high side is constituted by line 18 or by line 20.

As previously noted, the value of the high side pressure is a function of the magnitude of the load in relation to the opposing force generated by the power means at the winding drum. The high side pressure is thus an indication of potentially dangerous overload conditions. Line 87, together with branch lines 92 and 98, transmits the pressure signal to the appropriate cylinder 94 or 96, which thereupon applies a restraining force on manual controller in proportion to the magnitude of the pressure signal. Therefore, the restraining force on the manual controller progressively increases as the effective load builds up to a dangerous value. After some experience the operator gains a feel as to when the load becomes excessive; he thus is able to operate the controller at power inputs which are safe yet effective for hoisting purposes. The pressure sensing means functions on either side of neutral; therefore the feedback signal is effective while reeling in or reeling out. The restraining force on the controller keeps pace with load changes so that response time is comparatively good.

The principal advantage of the system is that it permits the operator to easily move the controller toward the "high speed" positions when load conditions so permit, while it restrains the operator from moving the controller toward the high speed positions when the load becomes excessively high.

We wish it to be understood that we do not desire to be limited to the exact details of construction shown and described for obvious modifications will occur to a person skilled in the art.

We claim:

1. In combination, a power means for rotating a winch drum in the reel-in or reel-out directions; said power means comprising a variable displacement pump having a mechanically-operated volume adjuster movable in opposite directions from a neutral zero flow position to a high flow reel-in position or to a high flow reel-out position, a fixed displacement hydraulic motor energized by the pump output to drive a winch drum in either a reel-in or reel-out direction; separate first and second hydraulic lines connecting the pump and motor in a closed loop circuit so that during reel-in operations the first line constitutes the pump output, and during reel-out operations the second line constitutes the pump output; a manual controller having a mechanical connection with the volume adjuster for thereby controlling the power means, said controller being movable in opposite directions from a neutral zero flow position to various high flow reel-in or reel-out positions; first hydraulic cylinder means arranged to exert a restraining force on the controller as it moves from its neutral position in one direction; second hydraulic cylinder means arranged to exert a restraining force on the controller as it moves from its neutral position in the other direction; a first sensor line transmitting pump output pressure to the first hydraulic cylinder means only when the controller is in the reel-in operational mode; and a second sensor line transmitting pump output pressure to the second hydraulic cylinder means only when the controller is in the reel-out operational mode.

2. The combination of claim 1: each sensor line being operatively connected to its associated hydraulic cylinder means through a valve that is controlled by movement of the controller.

3. The combination of claim 1: and further comprising valve means controlling flow of pressure fluid through each sensor line to its associated hydraulic cylinder means; and means controlled by the controller for operating each valve means so that pump output pressure is transmitted to the first hydraulic cylinder means only when the controller is in the reel-in operational mode, and pump output pressure is transmitted to the second hydraulic cylinder means only when the controller is in the reel-out operational mode.

4. The combination of claim 3 each valve-operating means comprising a solenoid energized by an electric switch, and cam means movable by the controller to open or close the respective switch.

* * * * *